United States Patent [19]

Balmer

[11] 3,951,665

[45] Apr. 20, 1976

[54] DIRECT-POSITIVE SILVER HALIDE EMULSION FOGGED WITH A TIN (II) CHELATE

[75] Inventor: Hans-Willi Balmer, Wallenried, Switzerland

[73] Assignee: Ciba-Geigy AG, Basel, Switzerland

[22] Filed: Jan. 14, 1974

[21] Appl. No.: 432,916

[30] Foreign Application Priority Data

Jan. 17, 1973 Switzerland ..... 687/73

[52] U.S. Cl. ..... 96/108

[51] Int. Cl.[2] ..... G03C 1/28

[58] Field of Search ..... 96/108; 260/429.7, 606.5 P; 423/305

[56] References Cited

UNITED STATES PATENTS

| | | | |
|---|---|---|---|
| 2,487,850 | 11/1949 | Carroll | 96/108 |
| 3,501,311 | 3/1970 | Lincoln et al. | 96/107 |
| 3,501,313 | 3/1970 | Willems et al. | 96/108 |
| 3,549,677 | 12/1970 | Griebstein et al. | 260/429.7 |

FOREIGN PATENTS OR APPLICATIONS

| | | | |
|---|---|---|---|
| 1,209,050 | 10/1970 | United Kingdom | 96/59 |

OTHER PUBLICATIONS

Westerback, et al., Journal of the American Chemical Society, 87:12, June 20, 1965, pp. 2567–2572.

Research Disclosure, 1973, pp. 44–46.

*Primary Examiner*—Won H. Louie, Jr.

*Attorney, Agent, or Firm*—Joseph G. Kolodny; Edward McC. Roberts; Prabodh I. Almaula

[57] ABSTRACT

The present invention relates to a modification of the sensitivity of photographic silver halide emulsions: A chelate of divalent tin is added to the emulsion before drying.

1 Claim, No Drawings

DIRECT-POSITIVE SILVER HALIDE EMULSION FOGGED WITH A TIN (II) CHELATE

Compounds of divalent tin are strong reducing agents. Their use in the preparation of emulsions and in the processing of photographic materials has been studied from many sides.

According to U.S. Pat. specification No. 2,487,850 and German Patent specification 939,422, compounds of divalent tin are good reduction sensitisers.

According to German Offenlegungsschrift 1,547,781, DT Patent specification 1,547,782 and others, compounds of divalent tin serve to form fogging nuclei in direct-positive emulsions. However, as has been shown in German Offenlegungsschrift 1,797,239, difficulties arise in that case. This is because if stannous chloride is used in the vicinity of the neutral point, a direct-positive emulsion is not obtained; rather, the desired object is only achieved if the emulsion is brought into contact with stannous chloride at pH values below 3.5 and the pH value is only raised after exposure.

Chelate compounds of divalent tin have been proposed for processing solutions in order chemically to fog the material before the second development in reverse development processes for example according to German Offenlegungsschrift 1,814,834 and German Offenlegungsschrift 2,009,693.

The salts of divalent tin suffer from the disadvantage that they hydrolyse in a neutral medium and hence must be used in alkaline solution as stannites or in acid solution as stannous salts. The acid solutions and in particular the alkaline solutions are easily oxidised by atmospheric oxygen so that such solutions do not give reproducible results. In particular, these pH conditions are unfavourable because photographic silver halide emulsions suffer extensive changes in the acid or alkaline range. Hence, the use of compounds of divalent tin in the production of photographic emulsions has only been possible to a limited extent.

It has now been found that these disadvantages can be avoided if, instead of simple salts of divalent tin, chelates are used for modifying photographic silver halide emulsions. Accordingly, the invention relates to a process for the production of a photographic material in which a photographic gelatine/silver halide emulsion is applied to a base and dried. In this process, a chelate of divalent tin is added to the emulsion before drying. Instead of the chelate, a corresponding mixture of compounds, that is to say a mixture of a tin-II salt, on the one hand, and a chelating agent, on the other, can also be used.

The tin-II chelates are relatively insensitive to oxygen so that stable solutions can be produced from such chelates. The pH-value of the solutions can be selected within a broad range so that inherently the most advantageous pH range can be used both during preparation and storage of the emulsion and during casting and subsequent processing.

The chelates are prepared from tin-II salts and chelating agents. Tin-II salts which can be used are tin-II halides such as tin-II bromide, tin-II chloride and tin-II fluoride, or other salts such as tin-II acetate, tin-II sulphate and tin-II tartrate.

Examples of chelating agents (ligands) which can be used are aminocarboxylic acids such as polyaminopolycarboxylic acids. Because of the greater solubility of the chelates, derivatives of phosphoric acid and of phosphonic acid are preferably used as ligands. These include: tetra-sodium diphosphate 10-hydrate, and the polydentate organophosphonate chelating agents such as are described by S. Westerback, K. S. Rayan and A. E. Martell in Journal of the American Chemical Society, 87:12 /June 20 1965, page 2,567-2,572, under the title "New Multidentate Ligands, III Amino Acids Containing Methylenephosphonate Groups". These aminomethylenephosphonic acids have the formula (1)

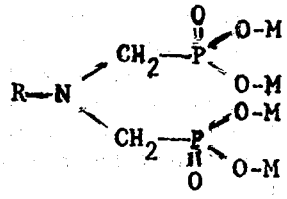

M is a hyrogen atom or some other cation which confers solubility in water, for example a sodium ion or potassium ion or an ammonium, triethylammonium, pyridinium or triethanolammonium group. R is an alkyl group with 1 to 4 carbon atoms, for example an ethyl, isopropyl, propyl, methyl or butyl group, or an optionally substituted aryl group, for example a phenyl, o-, m- or p-toluyl or o- or p-carboxyphenyl group, it being possible for the carboxylic acids to be in the form of water-soluble salts, such as potassium salts and sodium salts. Furthermore, if R denotes an alkyl group, this substituent R can be substituted by hydroxyl, $PO_3M_2$-$CH_2PO_3M$ or $—N(CH_2PO_3M_2)_2$ group, wherein M has the abovementioned meaning or denotes a chlorine atom or an alkoxy group, for example a methoxy or ethoxy group.

As examples of this abovementioned formula, the following compounds may be mentioned: 2-pyridylamino-N,N-dimethylenephosphonic acid, o-toluidine-N,N-dimethylenephosphonic acid, 1,6-hexanediamine-N,N,N′,N′-tetramethylenephosphonic acid, o-acetamidobenzylamino-N,N-dimethylenephosphonic acid, nitrilo-N,N,N-trimethylenephosphonic acid, ethylenediamine-N,N,N′,N′-tetramethylenephosphonic acid, o-carboxyanilino-N,N-dimethylenephosphonic acid, 1,2-cyclohexanediamine-N,N,N′,N′-tetramethylenephosphonic acid, propylamino-N,N-dimethylenephosphonic acid, 4-(N-pyrrolidino)-butylamine-N,N-bis-(methylenephosphonic acid), 1,3-diaminopropanol-N,N,N′,N′-tetramethylenephosphonic acid and 1,3-propanediamine-N,N,N′,N′-tetramethylenephosphonic acid.

However, it is also possible to use organo-phosphorus chelating agents of the formula (2)

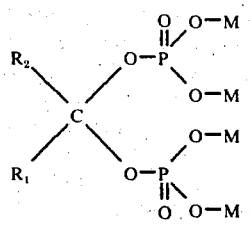

$R_1$ is a hydrogen atom or an alkylaryl, aralkyl or hetercyclic or alicyclic group or a $PO_3M_2$ group. $R_2$ is a hydrogen atom, a hydroxyl group, or an alkyl group as defined above or a $PO_3M_2$ group. M has the abovementioned meaning.

The following compounds conforming to this general formula may be mentioned: ethylidene-1,1,1-triphosphonic acid, 1-hydroxyethylidene-1,1-diphosphonic acid, 1-hydroxy-2-phenylethylidene-1,1-diphosphonic acid and 1-hydroxypropylidene-1,1-diphosphonic acid.

These chelates can be prepared by dissolving the chelating agent in water and adding the tin-II salt to the solution of the chelating agent. At least one equivalent of chelating agent is used per mol of tin-II salt. The stability of the chelate is increased if the chelating agent is used in excess, for example of up to 15 mols of chelating agent per mol of tin salt. The resulting chelate solution can then be adjusted to the desired pH value, for example to 7.

Examples of silver halides which can be used are silver chloride, silver bromide, silver chloride-bromide or silver bromide-iodide. Monodisperse or polydisperse, washed or unwashed emulsions can be used and the chelate can be added at any point in time, that is to say before, during or after the ripening of the emulsion. Preferably, "internal image emulsions" are used for the production of direct-positive emulsions.

These emulsions, described in the book: "The Theory of the Photographic Process" 3rd edition, by C. E. K. Mees and T. H. James, The Macmillen Co. New York, on page 161, under the title "Internal Image Desensitization", in most cases comprise a so-called core and a shell.

The amount of chelate depends on the desired end-use. For reduction sensitisation $10^{-8}$ to $10^{-6}$ gram atom of Sn per gram atom of Ag is in general used since fogging can occur with higher amounts of tin. For direct-positive emulsions, $10^{-3}$ to $10^{-1}$ gram atom of Sn per gram atom of Ag is advantageously employed, steeper gradations generally being obtained with increasing amount of tin chelate. The amount to be employed for any desired gradation can be determined experimentally.

The emulsions modified according to the invention can in addition be sensitised chemically, for example by sulphur sensitisers or noble metal salts. They can be spectrally sensitised and contain customary additives such as hardeners, casting auxiliaries, anti-fogging agents, chromogenic coupling agents, dyestuffs, pigments, matting agents and dispersed polymer latices. For example, the emulsions can also contain additives to enable them to be photo-developed, as in U.S. Pat. specification No. 3,033,678. The preferred binder is gelatine but this can be wholly or partially replaced by other binders. The emulsions can be cast, as single-layer or multi-layer material, on transparent carriers such as triacetate or polyesters or on opaque carriers such as paper or polyethylene-coated paper.

The materials can be developed conventionally. Next, there now follow manufacturing instructions for emulsions of types A to F, which are used in the subsequent examples for the production of photographic material according to the present invention. The percentages denote percentages by weight. "Water" is to be understood as deionised water throughout.

MANUFACTURING INSTRUCTIONS FOR EMULSIONS

Emulsion A 74.5 g of potassium chloride and 7.1 ml of an aqueous 1:1,000 rhodium chloride solution are added to 1,500 g of a 5% strength aqueous gelatine solution. The whole is heated to 55°C and 169 g of silver nitrate in 500 ml of water are added over the course of 3 minutes.

47.6 g of potassium bromide in 500 ml of water are added over the course of 15 minutes, with vigorous stirring throughout, and the mixture is then stirred for a further 10 minutes at 70°C.

A second portion of 71.4 g of potassium bromide in 500 ml of water is added dropwise over the course of 15 minutes. The mixture is again stirred for 10 minutes at 70°C, cooled to 35°C and flocculated with 250 ml of a 5% strength aqueous solution of the compound of the formula (3)

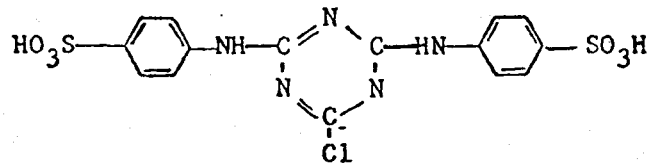

The pH value is adjusted to 4 with 2 N sulphuric acid. The supernatant water above the flocculated material is decanted and the flocculated material is washed three times with 3 liters of water at a time.

This flocculated material is redispersed in 500 g of 10% strength aqueous gelatine at 40°C. The pH value is adjusted to 7 with 2 N sodium hydroxide and the volume is made up to 1 liter with water.

Emulsion B 374 g of potassium chloride and 7.1 ml of a 1:1,000 aqueous rhodium chloride solution are added to 5 kg of a 5% strength aqueous gelatine solution. After warming to 55°C, 848 g of silver nitrate in 1,500 ml of water are added to this solution over the course of 1 minute.

A solution of 238 g of potassium bromide in 1,500 ml of water is added dropwise to the precipitate thus obtained over the course of quarter of an hour, with constant stirring. The whole is heated to 70°C and is well stirred for 10 minutes at this temperature.

A solution of 357 g of potassium bromide in 2,000 ml of water is run into the mixture containing the precipitate over the course of a further quarter of an hour.

The whole is again well stirred for 10 minutes at 70°C. The precipitate is subsequently cooled to 35°C and the pH value is adjusted to 4 with 2 N sulphuric acid.

750 ml of a 5% strength aqueous solution of the compound of the formula (3) are added to this precipitate. A flocculated material results.

The supernatant water above the flocculated material is decanted and the whole is washed three times with water.

The flocculated material is redispersed with 5 kg of a 5% strength aqueous gelatine solution over the course of 20 minutes at 50°C. The volume is adjusted to 10 kg with water. During redispersion, the pH value is raised to 7 with 2 N sodium hydroxide.

Emulsion C 119 g of solid potassium bromide and 7.1 ml of an aqueous 1:1,000 rhodium chloride solution are added to 1,500 g of 5% strength aqueous gelatine. The whole is heated to 55°C and 169.8 g of silver nitrate in 500 ml of water are poured in over the course of 3 minutes. 47.6 g of potassium bromide in 500 ml of water are then added dropwise over the course of quarter of an hour. The precipitate is well stirred for 10 minutes at 70°C and a further amount of 71.4 g of potassium bromide in 500 ml of water is then run in over the course of quarter of an hour. The precipitate is cooled to 35°C and flocculated with 250 ml of a 5% strength aqueous solution of the compound of the formula (3); at the same time the pH value is adjusted to 4 with sulphuric acid. The solution above the flocculated material is decanted and the flocculated material is subsequently washed three times with water. It is then redispersed with 1 kg of aqueous 5% strength gelatine solution at 50°C over the course of 20 minutes. At the same time the pH value is adjusted to 7 with 2 N sodium hydroxide.

Emulsion D 74.5 g of solid potassium chloride and 7.1 ml of a 1:1,000 rhodium chloride solution are added to 1,500 g of 5% aqueous gelatine solution. The mixture is heated to 55°C and 169.8 g of silver nitrate in 500 ml of water are poured in over the course of 3 minutes. 18.7 g of potassium chloride in 500 ml of water are then allowed to run in uniformly over the course of quarter of an hour. The precipitate is well stirred for 10 minutes and subsequently a further 55.8 g of potassium chloride in 500 ml of water are added dropwise over the course of quarter of an hour.

The precipitate is cooled to 35°C and flocculated with 250 ml of a 5% strength aqueous solution of the compound of the formula (3); at the same time, the pH value is adjusted to 4 with 2 N sulphuric acid. The solution above the flocculated material is decanted and the flocculated material is subsequently washed 3 times with water. It is then redispersed with 1 kg of aqueous 5% strength gelatine solution at 50°C over the course of 20 minutes. At the same time, the pH value is adjusted to 7 with 2 N sodium hydroxide.

Emulsion E 9 g of gelatine are dissolved in 500 ml of water at 55°C in a stainless steel vessel and 7 ml of a 20% aqueous cadmium nitrate solution are added thereto. 4 molar aqueous silver nitrate solution is fed in for 30 minutes with a pump which feeds 150 ml per hour. At the same time, the following solvent mixture is added with an identical pump: 25 ml of a 4 molar aqueous potassium bromide solution, 50 ml of a 4 molar lithium chloride solution and 175 ml of a 4 molar aqueous sodium chloride solution; the addition is made in such a way that the pAg value is constantly kept at 6.0 by means of a suitable device. The remainder of the two solutions is processed using the same device but pumps which take in 500 ml per hour.

The precipitate is cooled to 50°C and 14 ml of a 1:1,000 aqueous rhodium chloride solution are added. The whole is then brought to 65°C and stirred vigorously for 15 minutes.

Thereafter, the following solutions are introduced by means of pumps which take up 500 ml per hour, and the device described above, at a pAg value of 6:

With pump 1: 4 molar aqueous silver nitrate solution.

With pump 2: 45 ml of 4 molar aqueous potassium bromide solution and 5 ml of 4 molar aqueous sodium chloride solution.

The precipitate is flocculated by adding 150 g of crystalline sodium sulphate at 40°C.

The aqueous salt solution is decanted off and the resulting flocculated material is redispersed with a solution of 120 g of gelatine in 1,000 ml of water at 40°C.

Emulsion F

The following solutions are prepared:

| | | | |
|---|---|---|---|
| Solution I | Water | 600 | ml |
| 60°C | KBr | 60 | g |
| | KI | 1 | g |
| | NaCl | 18 | g |
| | $CdCl_2.H_2O$ | 3.5 | g |
| | Gelatine | 50 | g |
| Solution II | Water | 1,000 | ml |
| 58°C | $AgNO_3$ | 50 | g |
| Solution III | Water | 1,000 | ml |
| 58°C | $AgNO_3$ | 50 | g |
| Solution IV | Water | 150 | ml |
| 30°C | Compound of the formula (3) | 110 | g |
| Solution V | Water | 4,500 | ml |
| 30°C | | | |
| Solution VI | Water | 2,040 | ml |
| 40°C | Gelatine | 141 | g |

The solution I is kept in a water bath at 65°C for 10 minutes. The solution II is added over the course of 40 seconds with vigorous stirring and the solution III is then added dropwise over the course of 20 minutes. The mixture is cooled to 30°C and the pH value is adjusted to 4 with 2 N sulphuric acid. Solution IV is now added, and the mixture is stirred for 3 minutes at 30°C and then not stirred further for 20 minutes. The supernatant water is decanted. Solution V is added to the flocculated material and the mixture is stirred for 3 minutes at 30°C and then left to stand for 10 minutes. The supernatant water is again decanted. Solution VI is added at 40°C and the pH value is then adjusted to 6.0 with 2 N sodium hydroxide solution. The emulsion is well stirred for 40 minutes at 40°C, cooled and allowed to solidify. A silver chloride/bromide emulsion with 20 g of Ag/kg and a gelatine content of 6% is thus obtained. It is ripened by vigorously stirring the mixture for 110 minutes at 53°C.

EXAMPLE 1

75 ml of water are added to 150 g of emulsion A which has been melted in a water bath at 40°C. 15 ml of a solution containing 0.0056 g of tin-II chloride dihydrate and 0.0115 g of tetrasodium diphosphate decahydrate, dissolved in 1 liter of water, are worked into this emulsion. In addition, 10 ml of a 5% strength solution of an alkylbenzenesulphonate are introduced as a wetting agent. The pH value is adjusted to 7 with 2 N sodium hydroxide. The solution is poured on a transpatent carrier in an amount sufficient to give a layer having a thickness of 5$\mu$ to 6$\mu$ after it has cooled. Thereafter, it is exposed under a grey wedge and the strip is developed for 5 minutes at 20°C in a developer of the following composition:

| | |
|---|---|
| 1-Methylamino-4-hydroxybenzene | 1 g |
| Sodium sulphite | 40 g |
| Hydroquinone | 10 g |

-continued

| | |
|---|---|
| Potassium carbonate | 30 g |
| Potassium bromide | 7 g |
| Water | 1,000 ml |

The developed strip is then briefly soaked and fixed in a fixing bath of the following composition for 5 minutes:

| | |
|---|---|
| Sodium thiosulphate | 250 g |
| Sodium metabisulphite | 25 g |
| Water to make up to | 1,000 ml |

A positive image of the grey wedge used for exposure is obtained.

EXAMPLE 2

75 ml of water are added to 150 g of emulsion B which has been melted in a water bath at 40°C. 10 ml of a solution containing 56 g of tin-II chloride dihydrate and 23 g of hydroxyethylidenediphosphonic acid, dissolved in 1 liter of water, are worked into this emulsion. 10 ml of a 5% strength solution of an alkylbenzenesulphonate are added thereto. The pH value of this casting solution is adjusted to 7. The casting solution is poured on transparent cellulose triacetate film in an amount sufficient to give a dry layer having a thickness of 5–6$\mu$ after it has dried.

This strip is exposed under a grey wedge and thereafter the procedure of Example 1 is followed. A positive image of the grey wedge used for the exposure is obtained.

EXAMPLE 3

A strip produced as in Example 2 is exposed only after three months' storage at room temperature and is then developed and fixed as described. A positive image of the grey wedge used for the exposure is produced as in Example 2, that is to say no loss of effect is observable even after several months' storage of the material.

EXAMPLE 4

75 ml of water are added to 150 g of emulsion C which has been melted in a water bath at 40°C, and 10 ml of a solution containing 0.056 g of tin-II chloride dihydrate and 0.23 g of hydroxyethylidenediphosphonic acid, dissolved in 1 liter of water, are worked into this emulsion. 10 ml of a 5% strength aqueous solution of an alkylbenzenesulphonate are added thereto. The pH value is adjusted to 7 with 2 N sodium hydroxide solution. Thereafter the procedure of Example 1 is followed. A positive image of the grey wedge used for the exposure is obtained.

EXAMPLE 5

The procedure in Example 4 is followed but emulsion D is used instead of emulsion C. A positive image of the grey wedge used for the exposure is obtained.

EXAMPLE 6

The following additives are worked into 150 g of emulsion B: 75 ml of water, 5 ml of a solution containing 0.056 g of tin-II chloride dihydrate and 0.894 g of nitrilo-N,N,N-tri-[methylenephosphonic acid] of the formula (4)

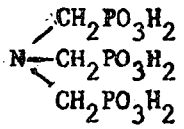

dissolved in 1 liter of water, and 10 ml of a 5% strength aqueous solution of an alkylbenzenesulphonate. The pH value is adjusted to 7 with 2 N sodium hydroxide.

Thereafter, the procedure of Example 1 is followed. A positive image of the grey wedge used for the exposure results.

EXAMPLE 7

The procedure in Example 6 is adopted except that the following fogging agent is added: 10 ml of a solution containing 0.056 g of tin-II chloride dihydrate and 5.07 g of ethylenediamine-N,N,N′,N′-tetramethylenephosphonic acid dissolved in 1 liter of water. A positive image of the grey wedge used for the exposure is obtained.

EXAMPLE 8

The following additives are introduced into 150 g portions of emulsion E: 75 ml of water, followed by the amounts, shown in the table which follows, of a solution L consisting of 0.056 g of tin-II chloride dihydrate and 0.23 g of hydroxyethylidenediphosphonic acid, dissolved in 1 liter of water.

The casting solutions listed in the table are adjusted to the pH value shown by means of 2 N sodium hydroxide solution.

a. fogged with 20 ml of solution L, pH 7
b. fogged with 20 ml of solution L, pH 8
c. fogged with 20 ml of solution L, pH 9
d. fogged with 20 ml of solution L, pH 10
e. fogged with 30 ml of solution L, pH 10
f. fogged with 40 ml of solution L, pH 10

After processing as in Example 1, a positive image of the grey wedge used for exposure is produced in each case.

If instead of the tin-II chloride chelate solution employed, a solution of 0.056 g of tin-II chloride dihydrate in 50 ml of water is used, but in other respects the same procedure as in Example 8 is followed, no silver is developed, that is to say no image is produced.

EXAMPLE 9

50 ml of water are added to 150 g of emulsion D kept at 40°C in a water bath. 10 ml of a solution containing 56 g of tin-II chloride dihydrate and 23 g of hydroxyethylidenediphosphonic acid dissolved in 1 liter of water are worked into this emulsion. 10 ml of a 5% strength solution of an alkylbenzenesulphonate are added thereto. The pH value of this casting solution is adjusted to 7 with 2 N sodium hydroxide.

10.5 g/kg of the compound of the formula (5)

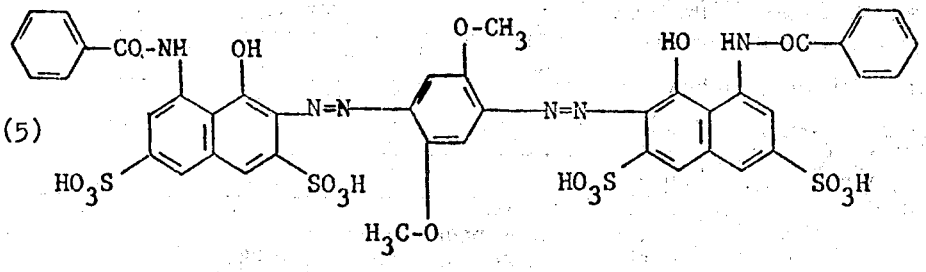

are added as an image dyestuff to this emulsion.

This image dyestuff shows an absorption maximum at 650 nm. The casting solution is cast on a triacetate carrier, the amount of silver applied being 1.50 g/m². This strip is exposed under a grey wedge and the material is then processed at 24°C, as follows:

6 Minutes developer

| | |
|---|---|
| p-Methylaminophenol sulphate | 2 g |
| Anhydrous sodium sulphite | 50 g |
| Hydroquinone | 6 g |
| Anhydrous sodium carbonate | 20 g |
| Potassium bromide | 2 g |
| Water to make up to | 1,000 ml |

2 Minutes stop-fixing bath

| | |
|---|---|
| Crystalline sodium thiosulphate | 200 g |
| Anhydrous sodium sulphite | 15 g |
| Sodium acetate (3 $H_2O$) | 25 g |
| Glacial acetic acid | 13 ml |
| Water to make up to | 1,000 ml |

4 Minutes soaking

20 Minutes dye-bleach bath

| | |
|---|---|
| Water | 500 ml |
| Sulphuric acid (96% strength) | 14 ml |
| Crystalline sodium hypophosphite | 1 g |
| Potassium iodide | 20 g |
| 6-Benzoylamino-2,3-dimethyl-quinoxaline | 30 mg |
| Water to make up to | 1,000 ml |

| | |
|---|---|
| Water | 500 ml |
| Sulphuric acid (96% strength) | 27 ml |
| Crystalline copper sulphate | 20 g |
| Potassium bromide | 60 g |
| Water to make up to | 1,000 ml |

2 Minutes soaking.

4 Minutes fixing bath

Composition as for stop-fixing bath.

8 Minutes soaking.

The result is a cyan image in the same sense as the grey wedge under which the material was exposed. If instead of the hydroxyethylidenediphosphonic acid, o-toluidine-N,N-dimethylenephosphonic acid is used in the same molecular ratio, similar results are obtained.

EXAMPLE 10

The procedure in Example 9 is followed except that in place of the compound of the formula 5, 12.5 g/kg of the compound of the formula (6)

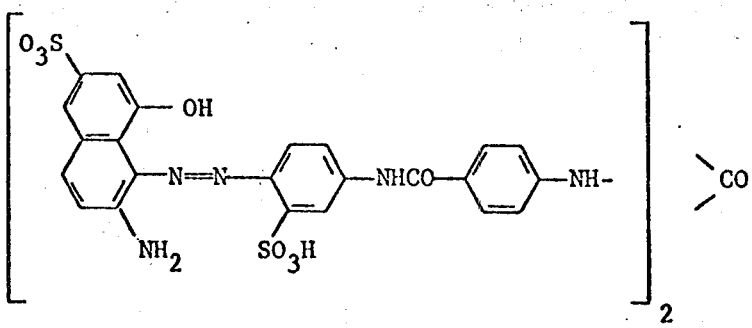

are added as an image dyestuff. The image dyestuff of the formula (6) shows an absorption maximum at 535 nm. A magenta image in the same sense as the grey wedge under which the exposure was made is obtained.

EXAMPLE 11

The procedure in Example 9 is followed except that in place of the compound of the formula 5, 12.7 g/kg of the compound of the formula (7)

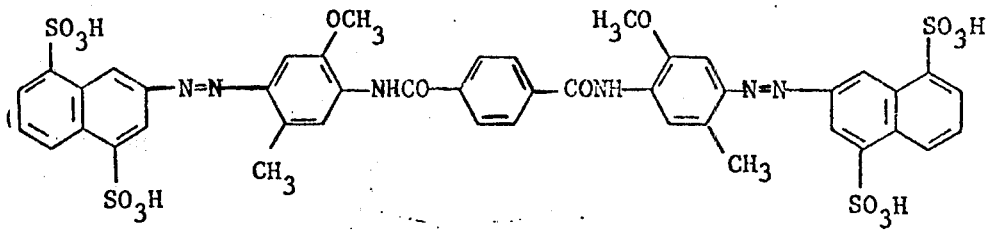

are added as an image dyestuff. The image dyestuff of the formula 7 shows an absorption maximum at 416

2 Minutes soaking

6 Minutes silver bleach bath nm. A yellow image in the same sense as the grey wedge under which the exposure was made is obtained.

EXAMPLE 12

50 ml of water and 10 ml of a 5% strength solution of an alkylbenzenesulphonate are added to 150 g portions of emulsion F. The amounts listed in Table 1 of the following solution are added to these casting solutions, kept at 40°C in a water bath: 0.056 g of tin-II chloride dihydrate and 0.23 g of hydroxyethylidenediphosphonic acid per liter of water.

Table 1

| | |
|---|---|
| a | 0 ml |
| b | 1 ml |
| c | 2 ml |
| d | 5 ml |
| e | 10 ml |
| f | 50 ml |

The pH value is adjusted to 7 with 2 N sodium hydroxide. These casting solutions are then cast on a triacetate carrier, the amount of silver applied being 1.5 g/m². These strips are exposed under a grey wedge and thereafter the procedure of Example 1 is followed. A sensitometric evaluation gives the values which are compared with one another in Table 2.

From these it can be seen that (up to an exposure corresponding to log E = 6.0) a reduction sensitisation takes place as a result of the addition of the amounts of tin-II chelates shown in Table I.

TABLE 2

| | optical density | | | | | |
|---|---|---|---|---|---|---|
| Rel. log E | a | b | c | d | e | f |
| 0 | 0.01 | 0.01 | 0.08 | 0.86 | 1.22 | 1.68 |
| 1.5 | 0.01 | 0.01 | 0.08 | 0.86 | 1.22 | 1.71 |
| 3.9 | 0.01 | 0.01 | 0.08 | 0.96 | 1.30 | 1.76 |
| 4.2 | 0.07 | 0.08 | 0.25 | 1.04 | 1.65 | 1.80 |
| 5.1 | 0.86 | 0.96 | 1.22 | 1.44 | 1.74 | 1.92 |
| 6.0 | 1.10 | 1.15 | 1.38 | 1.58 | 1.62 | 1.85 |

I claim:

1. A photographic direct positive material which contains, on a carrier, a light-sensitive silver halide emulsion layer containing, in an amount which corresponds to less than 1 gram atom and to at least $10^{-3}$ gram atom of tin per gram atom of silver, a divalent tin chelate of a chelating agent corresponding to one of the formulae $$RN(CH_2PO_3M_2)_2\,,\quad \begin{matrix} R_2 \diagdown & & \diagup PO_3M_2 \\ & C & \\ R_1 \diagup & & \diagdown PO_3M_2 \end{matrix} \quad \text{and } O(PO_3M_2)_2$$

wherein

R denotes an alkyl group or an aryl radical, $R_1$ denotes a hydrogen atom, an alkylaryl or aralkyl radical, a heterocyclic or alicyclic group or a $M_2O_3P$, $R_2$ denotes a hydrogen atom or a hydroxyl, alkyl or $M_2O_3P$ group and M denotes a cation which confers solubility in water; or a mixture of a salt of divalent tin and one of said chelating agent which forms said chelate, said silver halide emulsion layer having been chemically fogged by said divalent tin chelate or a mixture of a salt of divalent tin and one of said chelating agent which forms said chelate.

* * * * *